United States Patent [19]

Gmelin et al.

[11] 4,383,513

[45] May 17, 1983

[54] FUEL INJECTION SYSTEM

[75] Inventors: Karl Gmelin, Ingelfingen-Bühlhof; Klaus-Jürgen Peters, Affalterbach, both of Fed. Rep. of Germany

[73] Assignee: Robert Bosch GmbH, Stuttgart, Fed. Rep. of Germany

[21] Appl. No.: 153,654

[22] Filed: May 27, 1980

[30] Foreign Application Priority Data

Aug. 16, 1979 [DE] Fed. Rep. of Germany ..... 2933052

[51] Int. Cl.[3] ..... F02B 33/00

[52] U.S. Cl. ..... 123/454; 123/459; 123/455

[58] Field of Search ..... 123/454, 493, 463, 459, 123/455

[56] References Cited

U.S. PATENT DOCUMENTS

| | | | |
|---|---|---|---|
| 4,003,350 | 1/1977 | Eisele | 123/454 |
| 4,007,722 | 2/1977 | Knapp | 123/454 |
| 4,243,002 | 1/1981 | Freyer | 123/454 |

*Primary Examiner*—Ronald B. Cox

*Attorney, Agent, or Firm*—Edwin E. Greigg

[57] ABSTRACT

A fuel injection system is proposed which can be triggered such that when control signals characterizing engine overrunning are present, fuel injection is interrupted. To this end a pressure relief valve is provided, which opens in the presence of control signals characterizing engine overrunning and lowers the fuel pressure upstream of the fuel metering locations and accordingly upstream of the injection valves as well to below the opening pressure of the injection valves, so that no further fuel is injected via the injection valves during engine overrunning.

6 Claims, 2 Drawing Figures

FUEL INJECTION SYSTEM

BACKGROUND OF THE INVENTION

The invention relates to a fuel injection system of the type described. A fuel injection system is already known in which a bypass around the throttle valve is closed during overrunning. This does not, however, assure that during engine overrunning fuel injection will be reliably interrupted, so as to reduce both fuel consumption and the emission of toxic exhaust components.

OBJECT AND SUMMARY OF THE INVENTION

The fuel injection system according to the invention has the advantage over the prior art in that during engine overrunning it is assured that fuel injection will be reliably interrupted, so that during overrunning fuel is not consumed unnecessarily and toxic exhaust components are not emitted.

As a result, advantageous further embodiments of and improvements to the fuel injection system disclosed are possible.

The invention will be better understood and further objects and advantages thereof will become more apparent from the ensuing detailed description of two preferred embodiments taken in conjunction with the drawings.

DESCRIPTION OF THE PREFERRED EMBODIMENT

Figure 1:
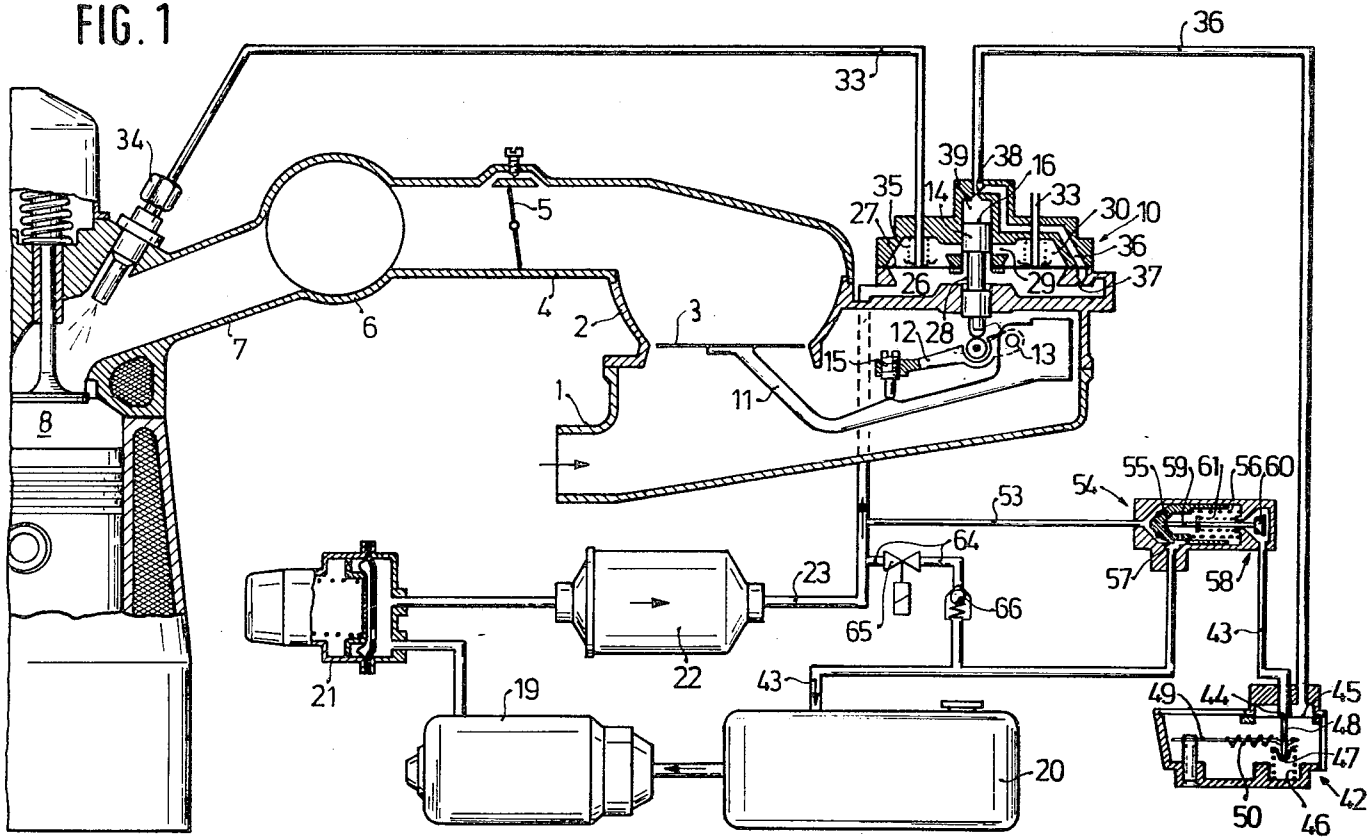
FIG. 1 shows a first exemplary embodiment of a fuel injection system with interruption of fuel injection during overrunning.

Turning now to FIG. 1, there will be seen a fuel injection system including an intake manifold 1 having a conical section 2 which contains an air flow rate member 3 beyond which there is located an induction tube region 4 containing an arbitrarily settable throttle valve 5. Intake air flows through the induction tube in the direction of the arrow to a manifold 6 from which it is directed via individual induction tube regions 7 to one or more cylinders 8 of an internal combustion engine.

In the present case, the air flow rate member 3 is a baffle plate disposed transversely with respect to the direction of air flow and capable of displacement within the conical region 2 of the induction tube as an approximately linear function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The motion of the air flow rate member 3 is transmitted by an operating lever 11 which is pivoted on the same shaft 13 as a correction lever 12 and which actuates the control slide 14 which is the movable member of the metering and distribution valve assembly 10. A mixture control screw 15 permits an adjustment of the desired fuel-air mixture. The end face 16 of the control slide 14 remote from the lever 11 experiences the pressure of a control fluid which is exerted onto the air flow rate member 3 and acts as a return force in opposition to the force of the flowing air.

Fuel is supplied by an electric fuel pump 19 which aspirates the fuel from a fuel tank 20 and delivers it through a storage container 21, a filter 22 and a fuel line 23 to the fuel metering and distribution assembly 10.

The fuel supply line 23 splits into several branches which lead to chambers 26 of the fuel valve assembly 10, whereby one side of a diaphragm 27 in each chamber is affected by fuel pressure. The chambers 26 also communicate with an annular groove 28 of the control slide 14. Depending on the axial position of the control slide 14, the annular groove overlaps control slits 29 to varying degrees permitting fuel to flow into chambers 30 which are divided from the chamber 26 by the diaphragm 27. From the chambers 30, fuel flows through the injection channels 33 to the individual injection valves 34 which are located in the vicinity of the engine cylinders 8 in the induction tube region 7. The diaphragm 27 is the movable valve member of a flat seat valve which is held open by a spring 35 when the fuel injection system is not operating. The diaphragm boxes defined, in each case, by a chamber 26 and a chamber 30, insure that the pressure drop at the metering valve 28, 29 is substantially constant independently of the relative overlap between the annular groove 28 and the control slits 29, i.e., independently of the fuel quantity metered at the metering valve 28, 29 and flowing to the injection valves 34. This insures that the metered out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 into which one end face 16 of the control slide 14 extends.

The control pressure line 36 contains a control pressure valve 42 which permits control fluid to return to the fuel tank 20 via a return line 43 without pressure. The control pressure valve 42 permits changing the pressure which produces the restoring force during the warm-up of the engine in dependence on time and temperature. The control pressure valve 42 is a flat seat valve having a fixed control valve seat 44 and a diaphragm 45 which is loaded in the closure direction by a spring 46. The spring 46 acts via a spring support 47 and a transmission pin 48 upon the diaphragm 45. When the engine temperature is below the normal operating temperature a first bimetallic spring 49 acts in opposition to the force of the spring 46. The bimetallic spring 49 carries an electric heater 50, the operation of which after starting causes a diminution of the force of the bimetallic spring 49 on the spring 46, and by this means the control pressure in the control pressure line 36 increases.

A line 53 branches off from the fuel supply line 23 and a pressure regulator valve 54 is disposed in this line 43, by means of which a constant fuel pressure is maintained upstream of the fuel metering valve 28, 29. The pressure regulator valve 54 shown by way of example in the drawing has a regulator piston 55, which can be displaced by the fuel pressure in the line 53 counter to the force of a regulator spring 56, so that fuel can flow over a regulator edge 57 out of the line 53 into the return line 43 and back to the fuel tank 20. At the same time, by means of the opening regulator piston 55, a barrier valve 58, which is disposed directly downstream of the pressure control valve 42 in the return line 43, can be opened. To this end, the regulator piston 55, in the act of opening and when the engine is running, engages an actuation pin 59, which displaces the movable valve element 60 in the opening direction, counter to the force of a barrier spring 61. If the engine is shut off, then there is no further fuel supply on the part of the electric fuel pump 19, and the pressure regulator valve 54 closes. At the same time, the barrier spring 61 engaging the actuation pin 59 displaces the movable valve element 60 of the barrier valve 58 into the closed position, so that leakage of fuel from the control pressure line 36 via the pressure control valve 42 is precluded and the fuel injection system remains filled with fuel and ready for the next startup of the engine. In a bypass line 64 around the pressure regulator valve 54, which branches off from the fuel supply line 23, there are an electromagnetic valve 65 and downstream therefrom a pressure relief valve 66, by way of which, when it is open, fuel can flow into the return line 43 and from there to the fuel tank 20. The electromagnetic valve 65 is connected to an electronic control appliance in a manner not shown and is triggered thereby in such a way that when control signals are present which characterize the overrunning condition on the part of the engine, this valve 65 opens. Engine overrunning is characterized, for instance, by the location of the throttle valve in a position for idling while the engine rpm are at a level above the idling level. The spring force of the pressure relief valve 66 is established such that the pressure relief valve 66 opens at a lower fuel pressure than the opening pressure of the injection valves. Now if the electromagnetic valve 65 opens during engine overrunning, then a lower fuel pressure is established by the pressure relief valve 66 upstream of the fuel metering valve 28, 29, so that the injection valves 34 and the pressure regulator valve 54 close; as a result, undesirable fuel injection is avoided and the formation of toxic exhaust gases is prevented.

Figure 2:
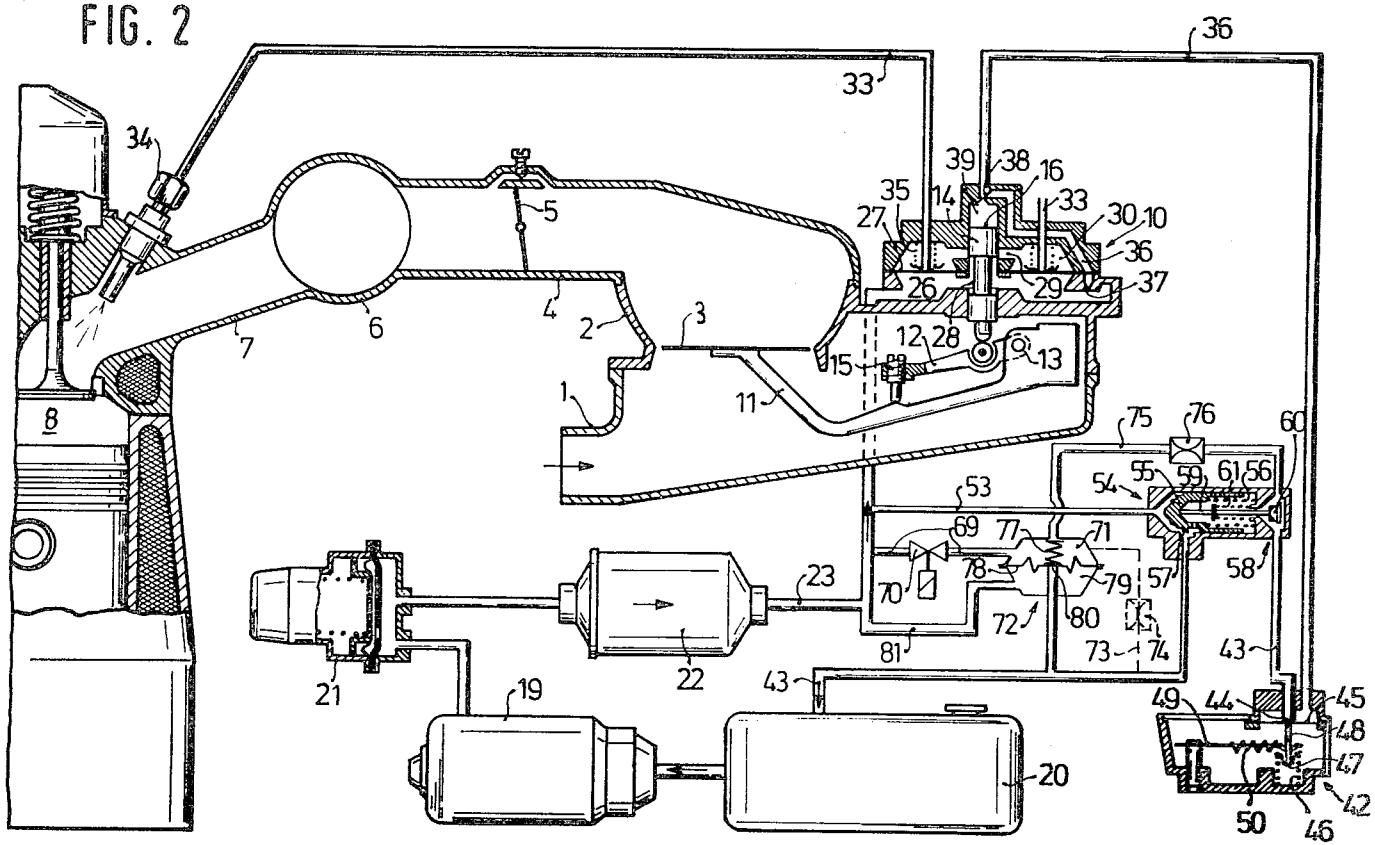
FIG. 2 shows a second exemplary embodiment of a fuel injection system with interruption of fuel injection during overrunning.

In the exemplary embodiment of FIG. 2, the elements having the same function as in the exemplary embodiment of FIG. 1 are given identical reference numerals. In a bypass line 69 branching off from the fuel supply line 23, an electromagnetic valve 70 which is open during normal engine operation and downstream thereof a first chamber 71 of a pressure relief valve 72 are disposed. The first chamber 71 of the pressure relief valve is connected either, as indicated by broken lines, directly with the return line 43 via a line 73 having a limiting throttle location 74, or via a line 75 having a limiting throttle location 76 with the return line 43 upstream of the barrier valve 58. When the engine is not running, the barrier valve 58 thus also prevents leakage of fuel out of the line 75. In the first chamber 71 of the pressure relief valve 72, there is a spring 77 which rests against a diaphragm 78, acting as the movable valve member, which separates the first chamber 71 from a second chamber 79. In the second chamber 79 there is a fixed valve seat 80, by way of which, when the pressure relief valve 72 is in the open position, fuel can flow into the return line 43. The second chamber 79 communicates via a line 81 with the fuel supply line 23. The spring force of the spring 77 of the pressure relief valve 72 is selected to be such that the pressure relief valve opens at lower pressures than the opening pressure of the injection valve. During normal engine operation, the electromagnetic valve 70 is open, and a fuel quantity limited by the limiting throttle location 76 flows via the first chamber 71 of the pressure relief valve 72 back to the return line 43. Thus the same fuel pressure prevails in the first chamber 71 as in the second chamber 79 of the pressure relief valve 72, and the pressure relief valve 72 remains closed as a result of the supplementary force of the spring 77. When control signals characterizing engine overrunning are present, the electromagnetic valve 70 closes, and the fuel pressure in the first chamber 71 drops to the fuel pressure in the tank, which amounts to approximately 1 bar. As a result, the pressure relief valve 72 opens and thus the pressure directly upstream of the injection valves 34 also drops below the opening pressure of the injection valves 34, so that no further fuel is injected through the injection valves 34 in this operational state of the engine.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for mixture-compressing externally ignited internal combustion engines comprising a fuel supply line, at least one fuel metering location disposed in said fuel supply line for metering a quantity of fuel dependent on operating characteristics of the engine an intake manifold, at least one injection valve having an opening pressure for injecting a quantity of fuel into said intake manifold, a pressure regulator valve which holds the fuel pressure upstream of each fuel metering location constant, a fuel tank, means downstream of said pressure regular valve through which fuel can flow back to said fuel tank, characterized in that by control signal means characterizing engine overrunning the fuel pressure upstream of each said fuel metering location can be reduced in such a manner that the fuel pressure downstream of each said fuel metering location drops below the opening pressure of said injection valves.

2. A fuel injection system as defined by claim 1, comprising a bypass line connected to said fuel supply line upstream from said fuel metering locations, said by-pass line being connected to bypass said pressure regulator valve, an electromagnetic valve disposed in said bypass line, said electromagnetic valve arranged to open upon sensing overrunning conditions of said engine, a pressure relief valve in said bypass line arranged to empty into said fuel tank and said relief valve further having an opening pressure which is lower than said opening pressure of said injection valves.

3. A fuel injection system as defined by claim 1, which includes a pressure relief valve disposed in a bypass line, said bypass line being provided with an electromagnetic valve arranged to close upon sensing overrunning conditions of said engine, said pressure relief valve having an opening pressure in said bypass line, said pressure relief valve including a first chamber connected through a throttle means with said fuel tank, said first chamber of said pressure relief valve further including a movable valve member and spring means and an adjacent second chamber, said second chamber being responsive to fuel pressure upstream of said fuel metering location and adapted to control flow of fuel back to said fuel tank when said opening pressure of said relief valve is lower than said opening pressure of said injection valves.

4. A fuel injection system as defined by claim 3, characterized in that said throttle means is upstream of a barrier valve means, said barrier valve means arranged to be held open by a movable valve member of said pressure regulator valve.

5. A fuel injection system as defined claim 3, characterized in that said movable valve member comprises a diaphragm.

6. A fuel injection system as defined by claim 4, characterized in that said movable valve member comprises a diaphragm.

* * * * *